US005695255A

United States Patent [19]

LeBlond

[11] Patent Number: 5,695,255

[45] Date of Patent: Dec. 9, 1997

[54] SELF-POWERED PORTABLE ROCK CRUSHER

[75] Inventor: Joseph Michel LeBlond, Edmunston, Canada

[73] Assignee: F.A.H.R. Industries Inc., Edmunston, Canada

[21] Appl. No.: 747,839

[22] Filed: Oct. 16, 1996

Related U.S. Application Data

[63] Continuation of Ser. No. 421,915, Apr. 13, 1995, abandoned.

[51] Int. Cl.[6] ..... E01C 19/05

[52] U.S. Cl. ..... 299/39.1; 299/39.4; 404/91; 172/112

[58] Field of Search ..... 172/112; 299/36.1, 299/39.1, 39.4, 79.1, 101; 404/90, 91, 92

[56] References Cited

U.S. PATENT DOCUMENTS

| | | | |
|---|---|---|---|
| 2,312,471 | 3/1943 | Low | 404/121 |
| 2,905,456 | 9/1959 | Rafferty et al. . | |
| 3,732,023 | 5/1973 | Rank et al. | 404/90 |
| 4,417,627 | 11/1983 | Willibald . | |
| 4,560,009 | 12/1985 | Lindbeck | 172/112 X |
| 4,573,826 | 3/1986 | Piovesan . | |
| 4,704,045 | 11/1987 | Taylor et al. | 404/90 |
| 4,871,213 | 10/1989 | Hanson | 299/89 X |
| 4,878,713 | 11/1989 | Zanetis | 404/90 X |
| 5,259,692 | 11/1993 | Beller et al. | 404/90 |
| 5,354,147 | 10/1994 | Swisher, Jr. | 299/39 X |

FOREIGN PATENT DOCUMENTS 0160606 4/1990 European Pat. Off. .

*Primary Examiner*—James Lisehora
*Attorney, Agent, or Firm*—McFadden, Fincham

[57] ABSTRACT

There is disclosed a rock crushing device comprising a frame housing, a rock receiving and crushing chamber having a rotatable rotor, hammers having a generally clavate-shaped profile being releasably engagable with the rotor, mounted to a vehicle such that the crushing device is movable in a plurality of planes to the vehicle.

5 Claims, 5 Drawing Sheets

SELF-POWERED PORTABLE ROCK CRUSHER

This application is a continuation of application Ser. No. 08/421,915, filed Apr. 13, 1995, now abandoned.

FIELD OF THE INVENTION

The present invention is directed to a self-powered portable rock crusher and more particularly to machines which are especially adapted to prepare on-site material for use in constructing, maintaining, reconstructing or reconditioning road surfaces.

BACKGROUND OF THE INVENTION

Preparing a road for surfacing, resurfacing or reconditioning involves laying down a gravel-like surface which will serve either as the main surface, as in the case of forest roads, or as an underlay for roads surfaced with asphalt or similar material. The conventional practice is to establish borrow pits and have such material transported to the site at great expense. In addition, raw material from borrow pits usually requires pretreatment by crushing or screening to ensure a good grain-size distribution.

Machines are known which will process on-site surfacing materials for use in surfacing or resurfacing, but these machines, such as the one disclosed in U.S. Pat. No. 2,905,456, are directed to tearing up existing roads surfaced in asphalt or other similar material and not reducing raw on-site material such as hard boulders, rocks and stones to a surfacing material of appropriate particulate size.

Rock crushing apparatus exist for breaking rock located in the surface region of soil as disclosed in U.S. Pat. No. 4,417,627 and European Patent No. 0 160 606 B1. These apparatus have a horizontal rotor means lying cross-wise to the machine direction and on which tool sets for earth processing are radially mounted. These machines are mounted on tractors and have been designed to be used in farm fields to produce a mealy stone-mulch but are not adapted to process a windrow comprised of a concentrated conglomeration of boulders, rock and stone to a gravel of appropriate particulate size for surfacing purposes.

Another major disadvantage of such a conventional rock crusher is that it is lifted up when its hammers or ploughshares encounter a high concentration and volume of irregularly shaped hard material, large rocks or rocks embedded in soil. Such abrupt lifting-up unbalances the rock crusher and prevents the rotor means from functioning correctly with the result that unprocessed or only partially processed material accumulates in the crusher and causes the crusher to become overloaded and jammed with obvious adverse consequences.

A further disadvantage of prior machines is that they are driven by a power take-off transmission shaft from the tractor which acts through various mechanical means to impart rotary movement to a rotor means and a jamming or overloading of the crusher and a subsequent locking of the rotor means results in stalling of the tractor motor as well.

Another disadvantage of conventional rock crushers is that the degrees of freedom of movement of the rock crusher with respect to the vehicle on which it is mounted is limited, by the mounting means and the transmission shaft in particular, to raising and lowering the rock crusher with little rotational and tilting movement being possible. Manoeuvrability is also limited in some models by the use of training wheels mounted on the frame. This lack of manoeuvrability results in the rock crusher being quite unresponsive to changes in the density and volume of windrow material and severely restricts the options open to an operator to avoid an impending jam or overload situation or to optimally process material.

A still further disadvantage is that the cutting tools and hammers of prior machines are not adapted for crushing high concentrations of hard rock such as granite or large boulder sized material collected together in a windrow for processing. Under such conditions, the hammers and cutting tools undergo rapid and excessive wear and as the hammers wear, the clearance between the hammers and the anvils increases and thus the output particle size becomes excessively large.

A yet further disadvantage of the prior machines is that the rotor shaft is fabricated from one solid piece and is not easily replaced. In such crushers, the housing must be slotted to permit the removal of the rotor means and such slotting weakens the housing structure and contributes to machine vibration.

SUMMARY OF THE INVENTION

A feature of certain embodiments of the present invention therefore, is to remove such prior drawbacks to known crushing machines whereby material may be processed by a self-powered portable machine of improved efficiency which may be economically employed to reduce existing on-site material, and more particularly high concentrations of hard rock, boulders and stones to the appropriate particulate size for use as a road surfacing or resurfacing material. The use of on-site material exposed by scarification of the road surface or salvaged from ditches is more environmentally sensible and economic than using material transported to the site from borrow pits.

A further feature of another embodiment of the present invention is to provide a rock crushing device comprising frame means; a rock receiving and crushing chamber having rotatable rotor means therein; rock disintegrating means associated with the said chamber in the form of hammer means on the rotor means, the hammer means having a clavate shaped profile and being releasably engagable with the rotor means.

Yet another feature of another embodiment of the present invention is to provide a rock crushing device comprising a vehicle; frame means including means for movably mounting the frame means onto the vehicle; said mounting means comprising articulated members pivotally attached to said crushing device such that said device is movable in a plurality of planes relative to said vehicle; a rock receiving and crushing chamber, and rock disintegrating means associated with said chamber.

In another alternative embodiment, lateral motion of the crusher may be provided by suitable sub-chassis or other mechanical means where such motion is not provided for by the operator of the vehicle to which it is mounted moving the crusher laterally as a consequence of deliberately imparting a turning motion to the vehicle.

Another feature of the present invention is to provide a rock crushing device comprising frame housing means; a rock receiving and crushing chamber having rotatable rotor means therein; hammer means on said rotor means, said hammer means having a generally clavate-shaped profile and being releasably engagable with said rotor means; lateral plates; deflector plate; and said rotor means being disengageably mounted within said chamber by stub shaft means disengageably connected to said rotor means.

A self-powered portable rock crushing device is disclosed with hammer means which more effectively grab material being processed than prior crushing devices, and which hammers have wear characteristics that lead to longer operational life with the output particulate size remaining generally constant for a longer period of time than in prior crushers as the hammers wear. In addition, the crusher device can be tilted, rotated, raised and lowered and agitated or any combination thereof, to greatly improve the efficiency of material processing by accurately manipulating the crushing device to best respond to variations in material density and volume and the like during operation and to prevent jamming.

BRIEF DESCRIPTION OF THE DRAWINGS

Further advantages and features of the self-powered portable crushing unit according to the present invention will be more readily understood from the following description of preferred embodiments of this crushing unit, illustrated by way of example only. In the various views of the accompanying drawings.

DESCRIPTION OF PREFERRED EMBODIMENTS

Figure 1:
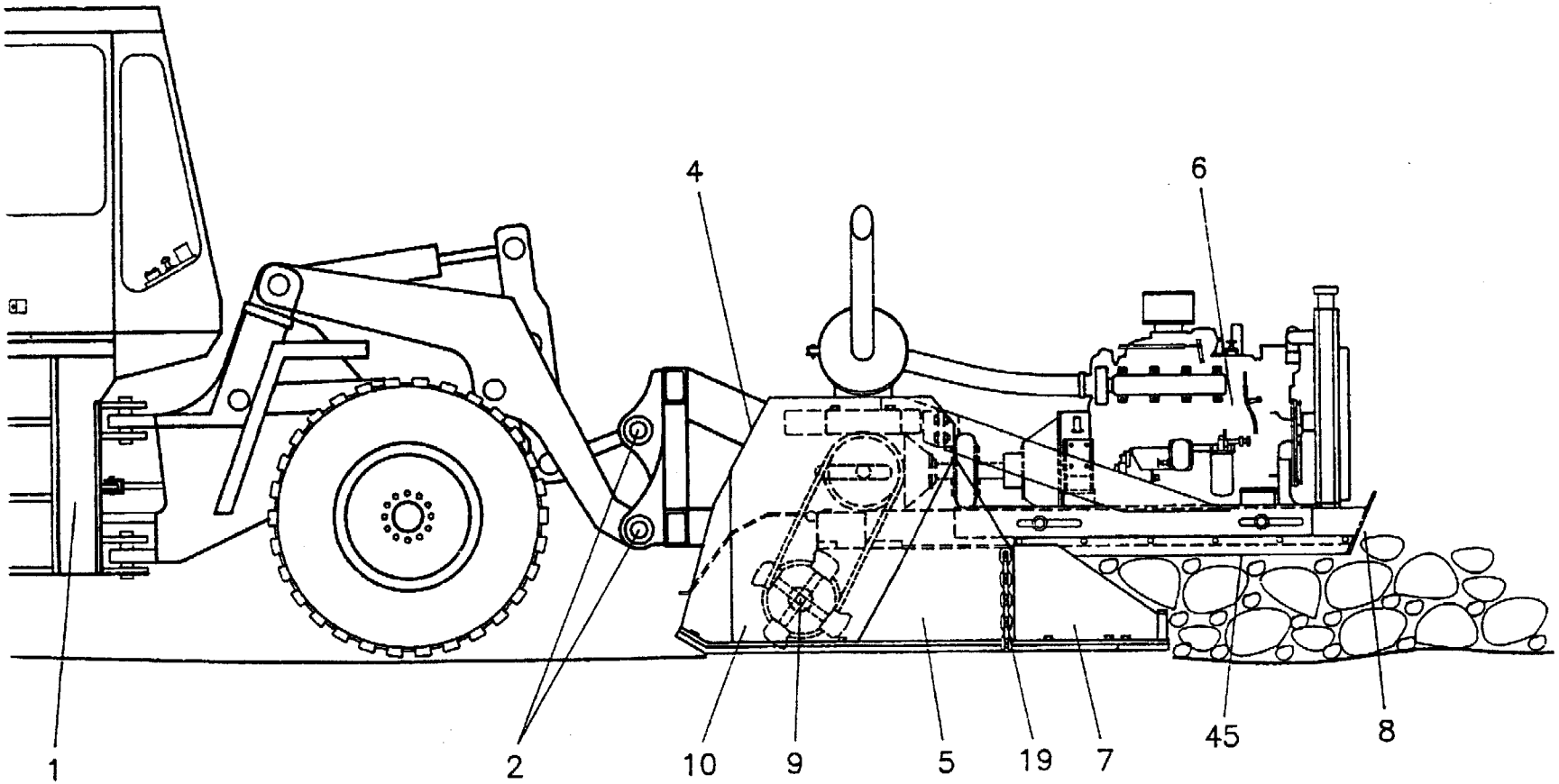
FIG. 1 shows a heavy duty vehicle with the crusher unit mounted.
Figure 2:
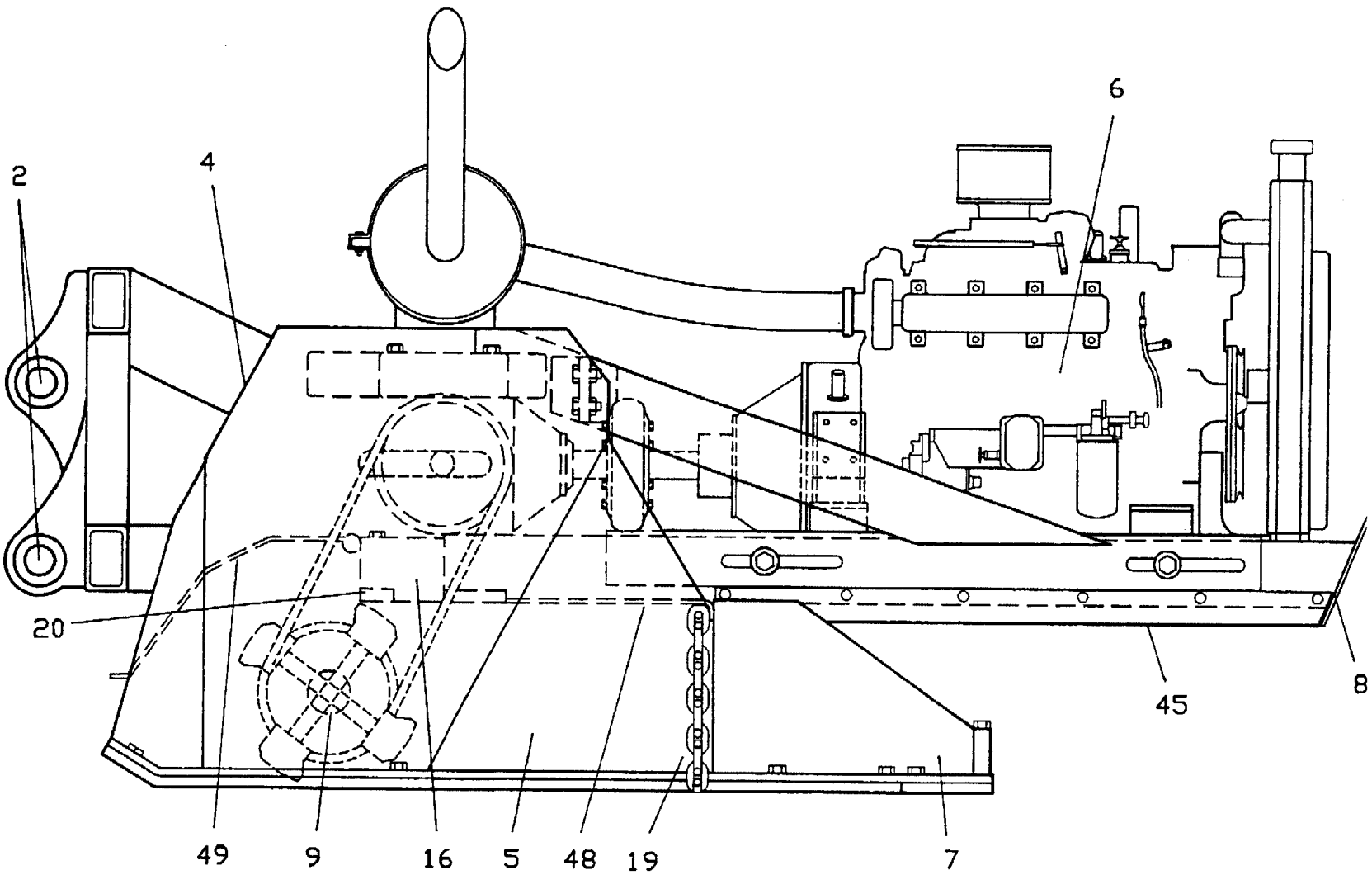
FIG. 2 shows a side view of the crusher unit and pivot connections.

Referring in particular to the various drawings, one preferred embodiment is illustrated which comprises a self-powered portable crushing unit mounted to a heavy duty vehicle 1 by means of pivot connections 2. The crusher device shown generally in FIG. 2 incorporates a heavy-duty frame housing shown generally by numeral 4 enclosing a rock receiving and crushing chamber 5 for receiving road surfacing material to be processed, an independent drive motor 6 providing power independent of said vehicle, and lateral plates 7 for stabilizing the crusher device during movement and operation and for confining the windrow material. The mounting arrangement 2 coupled with the use of the independent drive motor 6 allows the crusher of the preferred embodiment to be moved in at least one of a plurality of planes with respect to the vehicle 1 when mounted to conventional lifting means as shown in FIG. 1. It is thus, adaptable to changes in the density and volume of the windrow material being processed and this substantially reduces the risk of the crusher mechanism becoming unbalanced or jammed.

A deflector plate 8 as illustrated in the present embodiment is provided on the front of the frame housing 4 to deflect material away from the motor 6, as well as, level windrow material above a certain height by spreading it towards the sides of the windrow. The bottom motor drive mounting plate 45 prevents windrow material from being pushed up into said motor and the top plate 48 of the crushing chamber 5 limits the amount of material entering said chamber. A curtain of individual strands of chains 19 is suspended from the top plate 48 and helps prevent particulate material from being ejected from the front of the crusher.

Figure 3:
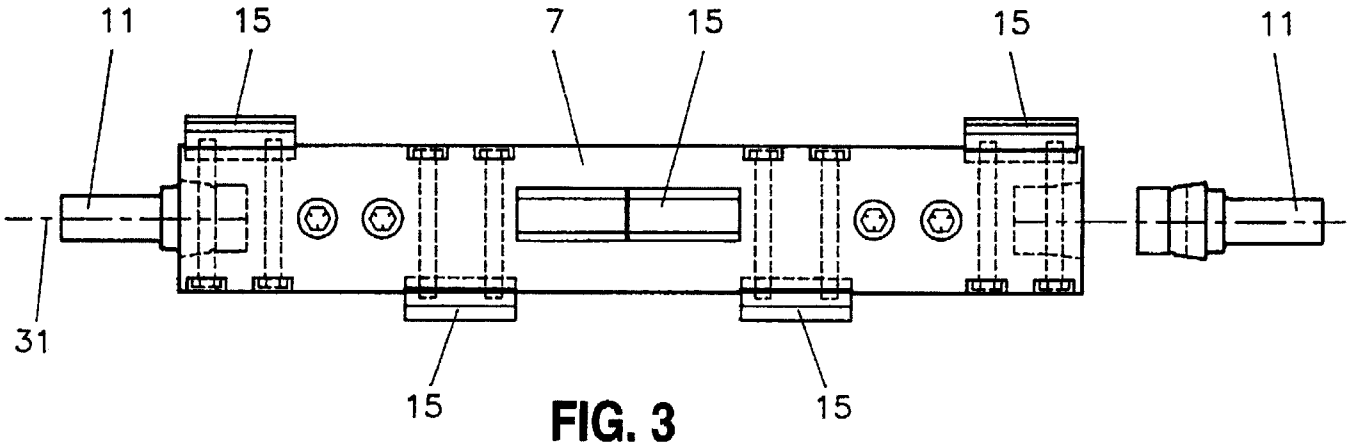
FIG. 3 is a front view of the rotor means with hammers.

The rock receiving and crushing chamber 5 incorporates a rotor means 9 running in a substantially horizontal axis perpendicular to the direction of movement of the vehicle 1 and rotatably mounted within the rock receiving and crushing chamber 5 between two side panels 10. The rotor means 9 is exposed to the ground directly beneath said chamber for receiving windrowed material lying on the ground or in the surface region of soil as the crusher unit moves over the road bed. The rotor means 9 is rotatably mounted to each of the side panels 10 forming part of the frame housing means 4 by means of heavy duty rotor stub shaft means 11 as seen in FIG. 3 which are easily disengagable from said rotor means. In FIG. 1, which shows the right hand side of the crusher, the direction of rotation of the rotor means 9 is counterclockwise. The stub shaft means 11 are threadably mounted to the rotor means, the left one having a right hand thread and the right one having a left hand thread as viewed from vehicle 1. The use of stub shaft means 11 eliminates the need to use side panels which are slotted to receive the rotor shaft. The result of using unslotted side panels 10 is a stronger more rigid frame structure.

Figure 6:
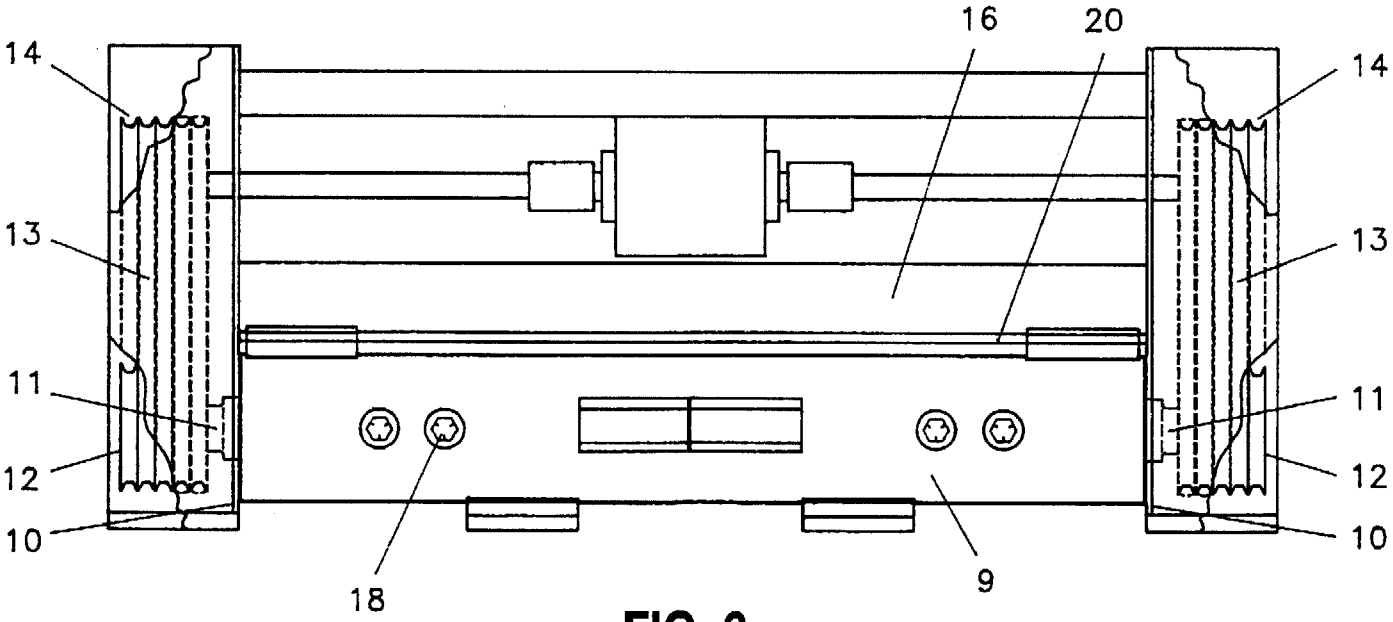
FIG. 6 shows a front view of the crusher.
Figure 5:
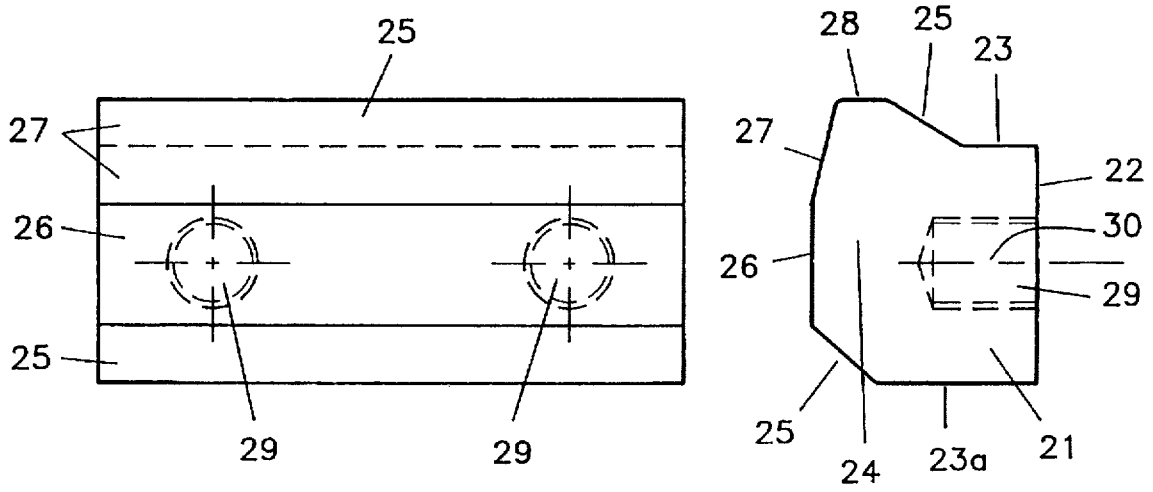
FIG. 5 shows a top view and a side view of the hammer.

Referring to FIG. 6, mounted on each of the stub shafts 11 are lower pulleys 12 which are rotated by a drive belt 13 which runs from said lower pulleys to the upper pulleys 14 which in turn are driven by a drive motor 6 which is independent of the vehicle 1 to which the crusher is coupled. The strength of the engine is dependant upon the power requirements of the crusher but a 225 horsepower engine has been found to be very suitable for the present embodiment as herein described. An RPM indicator is provided to monitor the working of the motor to help guard against the motor 6 from becoming overloaded from a jam for example. In the case of overloading or potential overloading, the motor 6 can be stopped without interrupting the power to the vehicle 1.

Hammer elements 15 are mounted about the rotor means 9 to perform the crushing and breaking-up action on the windrow material with minimal resistance. In the present embodiment, there are 8 hammers in four rows located on the rotor means 9. More hammers 15 can be placed on the rotor means 9 provided that they are positioned in the same generally balanced manner as the 8 hammers of the present embodiment, that is that in general, for each sectional length of the rotor means 9 along its length, only one hammer 15 is mounted on the said rotor means for that length. This hammer configuration aids in moving windrow material from the edges of the rotor means 9 toward the longitudinal centre of the machine as it is being processed by said rotor means. If desired, hammers 15 of at least two different sizes may be used.

The hammers 15 are securely mounted on the rotor means using bolts 18 which pass through the rotor means 9 so that each hammer 15 can be easily removed individually when they require replacing. The hammers 15 are profiled to accept the bolts 18 which are threadably rotated into position.

To cooperate with the hammers 15 to break down and pulverize material entering the crushing unit, removably mounted stationary wear element means 20 are attached to the anvil 16. The hammers 15 move past said wear element means, there being a clearance 17 between the hammers 15 and said wear element means. Material being processed by the rotor means 9 is drawn to the periphery of the rotor means 9 by centrifugal force and therefore, most of the material is drawn between the hammer 15 and the wear element means 20. Once the fragments become fine enough to pass between the hammers 15 and the wear element means 20, they are thrown back to the rear of the rock receiving and crushing chamber 5 and are deflected by the rear cover 49 onto the road surface behind the rotor means 9. The amount of clearance 17 between the hammers 15 and wear element means 20 determines the maximum particulate size which will pass between the hammers 15 and wear element means 20.

In the present embodiment, the hammers 15 are easily disengagable from the rotor means 9 and the rotor means is easily disengagable from the side panels 10 of frame housing 4 to facilitate servicing and replacement of the hammers 15 and the rotor means 9. The wear element means 20 are also disengagable from the anvil 16 for the same purpose.

Figure 4:
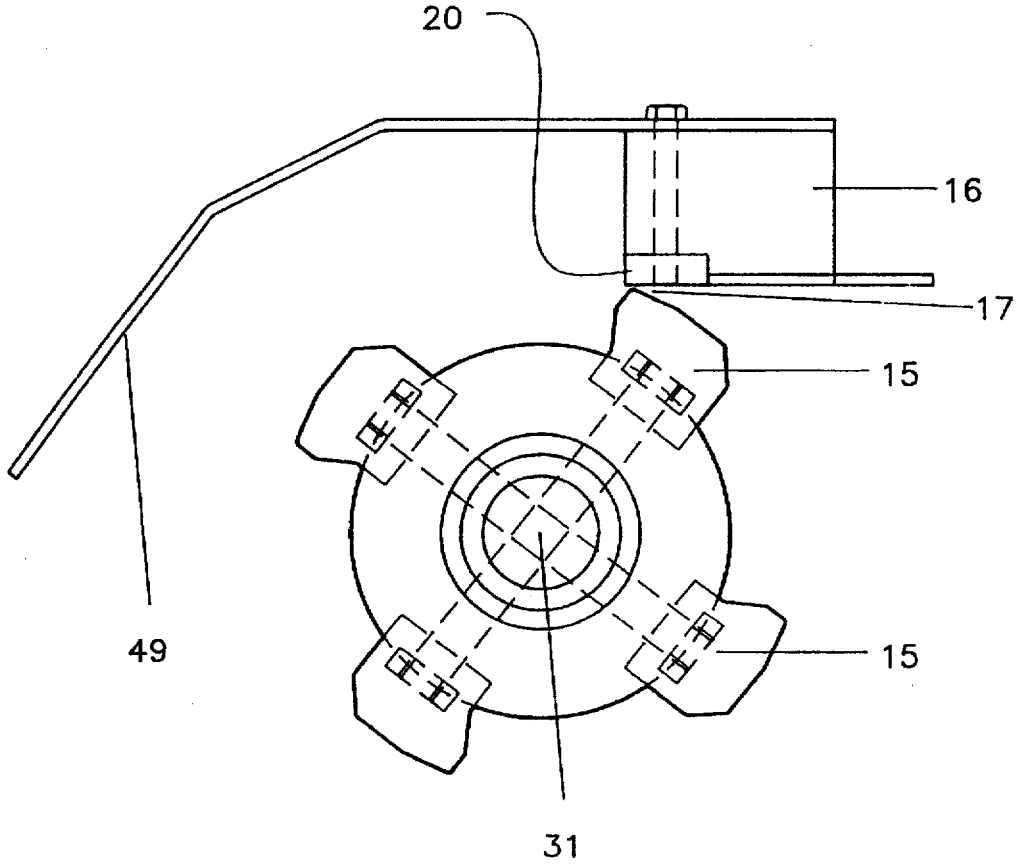
FIG. 4 is a side-view of part of the rock receiving and crushing chamber and rotor means.

Located on the periphery of the rotor means 9 are hammer means 15, one of which is shown in FIG. 4. The hammer 15 has its longitudinal axis laid generally horizontal and perpendicular to the direction of movement of the rotor means 9. The hammer 15 has a generally clavate-shaped profile to improve its crushing of hard rock such as granite and to minimize wear.

The hammer 15 comprises a base section shown generally by 21, having a flat bottom segment 22 and two relatively parallel side segments, front side segment 23 and rear side segment 23*a*; a head section shown generally by 24 comprising two angled relatively parallel segments 25; a top segment having a flat segment 26 and an inclined segment 27; a leading edge segment 28 relatively parallel to the said front side segment; and threaded holes 29 for receiving bolts. As the leading edge segment 28 wears with use, the clearance 17 between the hammer and the wear element means 20 remains constant and thus the maximum particle size which may pass between the hammer 15 and the wear plate element means 20 remains constant and a progressively variable clearance is avoided. The leading edge segment 28 is offset from the radial line 30 in cross-section connecting the centre of the hammer 15 to the horizontal rotor axis 31, and provides for better crushing of windrow material by facilitating the grabbing and positioning of the material. The leading edge 28 is offset by a greater amount from axis 30 than the front side segment 23 which is itself offset from axis 30.

Figure 7:
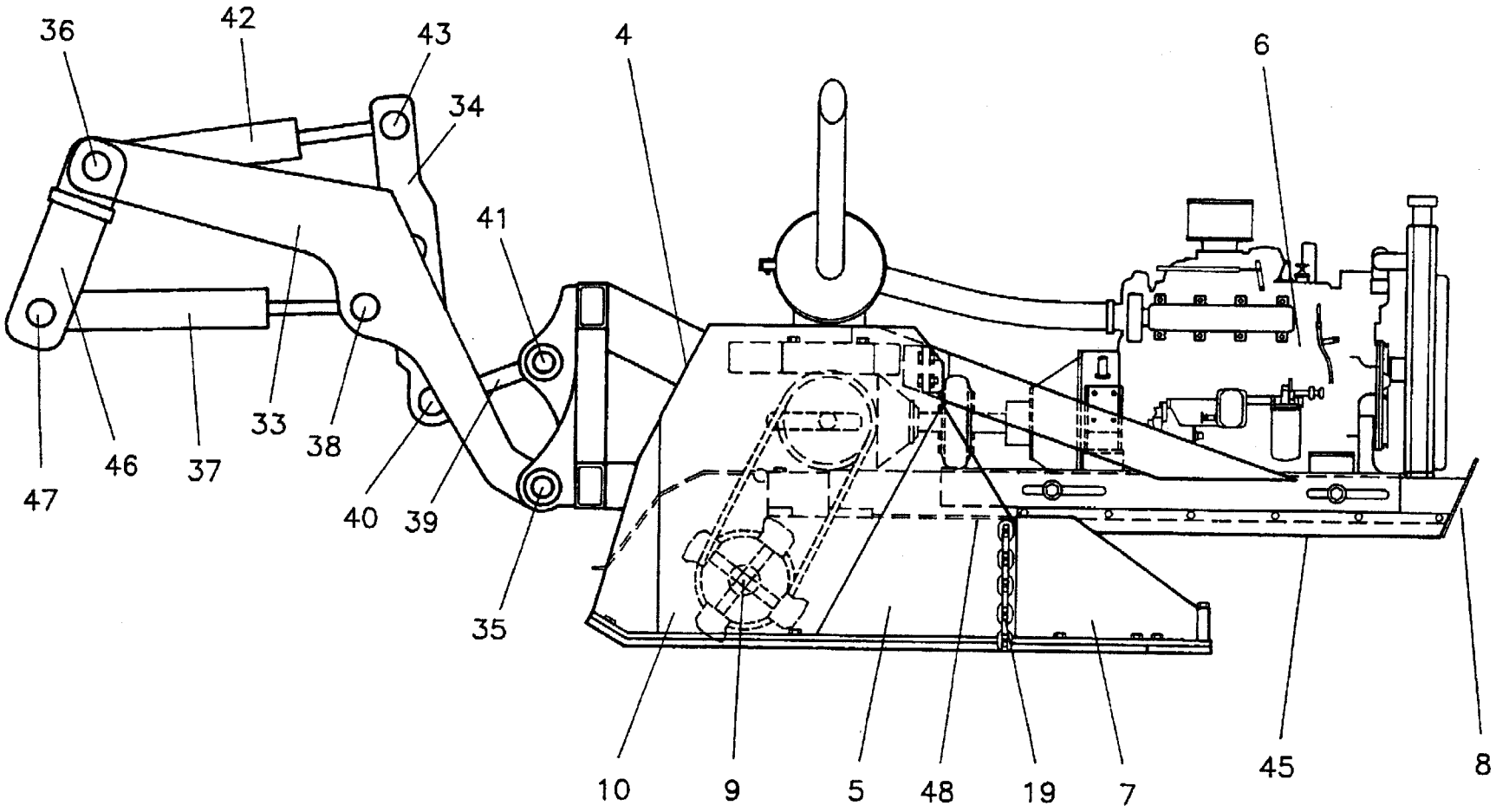
FIG. 7 shows a side view of the crusher unit and lifting means.

Referring now to FIG. 7, another preferred embodiment of this invention is shown with a mounting means having articulated members for mounting the crusher to a vehicle such as vehicle 1 shown in FIG. 1 to enable the crusher to be moved in a plurality of planes with respect to said vehicle. In particular, the mounting means comprises a main lifting member 33 for raising and lowering the crusher with respect to the ground and an actuatable member 34 for effecting rotation or tilting of the crusher about an axis generally parallel to the horizontal rotor means axis 31. The lifting member acts on the crusher through pivot connection 35 and has pivot connection 36 for connecting to a flange 46. Although only one lifting member and actuable member is shown, two or more can be provided. Lifting force for the said lifting member is provided by way of a hydraulic cylinder 37 pivotally connected to said lifting member at pivot points 38 and to the flange 46 at connection point 47. The actuatable member 34 for effecting rotation acts through linkage member 39 connected to said actuatable member for effecting rotation at hinge point 40 and to the crusher at hinge point 41. Rotational force for the said member effecting rotation is provided by a hydraulic cylinder 42 functionally connected to said rotation member at 43. It will be appreciated, however, that lifting and rotation force is not restricted to being provided by hydraulic cylinders and may be provided by any suitable fluid or mechanical means and any number of these can be used.

Thus, a rock crushing device is provided which is highly manoeuvrable and capable of moving in a plurality of planes with respect to the vehicle to which it is mounted and to respond to changing operating conditions, such as changes in terrain, grade, and density of rock, stone and other materials. In particular, the variety of freedoms of movement allow the angle of attack to be varied to suit said changing conditions and to provide a greater degree of control of the device to displace and agitate material within it thereby preventing the device from being lifted by the material. In particular, the crusher can be tilted about an axis generally parallel to the horizontal rotor axis 31, for example to lower the front of the crusher to increase the depth of operation. The lowering and raising of the front of the crusher can be combined for example with lifting and lowering the crusher and rotating the crusher in a plane generally parallel to the ground. It is understood that the various degrees of freedom of movement can be employed in various combinations to agitate and redistribute material within the crusher chamber 5 and to respond to changing conditions as described above, improve processing efficiency and substantially reduce the risk of jamming.

I claim:

1. A device for collecting and processing rock material from the surface of the ground, comprising:

a rock processing enclosure for receiving collected rocks;

rotatable rotor means within said enclosure;

a plurality of hammer elements each having a central axis mounted on said rotor means, said hammer elements configured for carriage and projection of rock material within said enclosure during rotation of said rotor means, said hammer elements maintaining a coplanar relationship with said surface of said ground, said hammer elements each including:

base means for connection with said rotor means, side segments extending from said base means, a first inclined segment and a second inclined segment extending from a respective side segment, the inclined segments being in a parallel and spaced apart relationship, a top segment extending from said first inclined segment, said top segment being in parallel spaced relation to said base means, said top segment being shorter in length than said base means, a downwardly inclined segment extending from said top segment and inclined downwardly relative to said top segment, a striking segment extending downwardly from said downwardly inclined segment, said striking segment in spaced parallel relation with one of said side segments and laterally offset relative to said central axis; and wear elements within said enclosure adjacent said hammer elements, said wear elements for providing a surface upon which said rock material may be broken into fragments by projection against said wear elements, said wear elements arranged with said hammer elements for pulverizing said fragments when said fragments contact an area between a hammer element and a wear element.

2. A device for collecting and processing rock material as defined in claim 1, wherein said rotatable rotor means is releasably mounted within said enclosure.

3. A device for collecting and processing rock material as defined in claim 2, wherein said hammer means are uniform in size.

4. A device for collecting and processing rock material as defined in claim 3, wherein said device is self-powered.

5. A device for collecting and processing rock material as defined in claim 4, wherein said device is a surface processing device.

* * * * *